US005666868A

United States Patent [19]

Diete et al.

[11] Patent Number: 5,666,868

[45] Date of Patent: Sep. 16, 1997

[54] MACHINE FOR THE TREATMENT AND PROCESSING OF FOODS

[75] Inventors: Gunter Diete, Obergünzburg; Christoph Ullmann, Kempten, both of Germany

[73] Assignee: Dixie-Union Verpackungen GmbH, Kempten, Germany

[21] Appl. No.: 297,774

[22] Filed: Aug. 30, 1994

[30] Foreign Application Priority Data

Sep. 30, 1993 [DE] Germany ..... 9314838 U

[51] Int. Cl.[6] ..... B26D 7/08

[52] U.S. Cl. ..... 83/168; 83/170; 83/932

[58] Field of Search ..... 83/170, 168, 15, 83/22, 16, 77, 932; 99/473, 474

[56] References Cited

U.S. PATENT DOCUMENTS

| | | | |
|---|---|---|---|
| 2,294,560 | 9/1942 | Bennett | 83/168 |
| 2,482,013 | 9/1949 | Marshall, Jr. | 83/168 |
| 4,152,963 | 5/1979 | Romanik et al. | 83/170 |
| 4,484,517 | 11/1984 | Amann | 99/474 |
| 4,503,760 | 3/1985 | Pryputsch et al. | 99/473 |
| 4,506,598 | 3/1985 | Meister | 99/474 |
| 4,817,582 | 4/1989 | Oslin et al. | 99/474 |
| 4,941,375 | 7/1990 | Kasper | 83/77 |
| 5,329,919 | 7/1994 | Chang | 99/474 |

FOREIGN PATENT DOCUMENTS

| | | | |
|---|---|---|---|
| 1361334 | 7/1974 | United Kingdom | 83/168 |

*Primary Examiner*—Rinaldi I. Rada
*Assistant Examiner*—Charles Goodman
*Attorney, Agent, or Firm*—Jacobson, Price, Holman & Stern, PLLC

[57] ABSTRACT

In a machine (1) for the treatment or processing of foodstuffs, e.g. the slicing of sausage, the incidence of contamination by germs in the casing (3) of the machine (1) is reduced by the provision of a heater arranged to heat the casing (3) and/or air contained within it to an elevated temperature. Most preferably, the heater comprises means (32,14) for heating and circulating air in the casing (3) and means (9) for directly heating the casing (3) itself.

17 Claims, 3 Drawing Sheets

MACHINE FOR THE TREATMENT AND PROCESSING OF FOODS

BACKGROUND OF THE INVENTION

This invention relates to a machine for the treatment or processing, of foods, in particular to a machine for the slicing of foodstuffs such as sausage.

Machines for the slicing of foodstuffs are commonly used in air-conditioned rooms where there is high relative atmospheric humidity at a low temperature. Great attention is invariably paid to hygiene during the processing of foods. Nevertheless, it is not always completely possible to guarantee a hygienically acceptable level of germs.

Even after thorough cleaning of the machine, it is possible for there to be a certain concentration of germs on or in the machine. In this context, the term "germ" is to be taken to include a variety of organisms such as microplasms, bacteria, viruses, fungi and spores. Therefore, contamination of the product with germs must always be reckoned with.

Such machines commonly have casings which enclose moving parts of the machine. It is generally difficult to clean the machine. The external surfaces are cleaned, for example, with high pressure cleaners and appropriate chemicals, but the washing fluid sometimes enters the machine casing. The dirty water then contains, for example, organic residues of cut product, water and chemicals added to the water. This mixture produces an ideal culture medium for various germs and, due to the climate prevailing in the interior of the machine, the population of certain germs may increase. The machines often have casing parts which are difficult to remove and behind which a culture then develops.

BRIEF SUMMARY OF THE INVENTION

The object of the present invention is to improve machines of the type generally described above such that the production of, for example, sliced foods such as sausage slices or the like takes place in a hygienic germ-free environment.

To achieve this object, the invention proposes that a machine of the above-described type have a casing which is heatable. The culture medium which may accumulate within the machine casing is then also heated by heating of the machine casing. This means that an environment is created for germs and bacteria which prevents the propagation thereof. Furthermore, the heating of the machine casing causes drying of the medium, impairing the quality of the medium. The germs are killed directly by an appropriate choice of temperature, it being important for the selected temperature not to be so excessively high that the machine is damaged.

It has been found to be advantageous for the gear casing of the cutting blade to be capable of being heated. In particular, the gear casing for the drive of the cutting head is difficult to clean as extensive time-consuming dismantling would be necessary.

Although the gear casing is enclosed, the driving shaft or the carrier shaft for the revolving blade axis projects from the gear casing. The gap between the gear casing and the rotating elements can be sealed with great difficulty and not hermetically. The comparatively great diameter and the high speed do not allow the provision of effective seals on the annular gap.

The external parts of the casing are generally cleaned intensively daily or after each shift. A jet with a cleaning fluid strikes the surface to be cleaned at high pressure. Cut residues and other organic material, for example, are located in the gap mentioned above and are flushed into the casing by the high pressure jet. This creates a medium which is suitable for the development of germs and is rarely removed, due to the difficulty in dismantling the casing.

The cutting blade is located above the delivery surface for the sliced product and there is a risk that droplets of liquid having a high germ concentration will fall onto the cut product. This can create a germ concentration which is harmful in terms of food hygiene on the sliced product.

The propagation of germs is impaired or prevented by providing a heating means in the machine casing.

It has proven advantageous to provide circulating air heating as heating means. Owing to the use of circulating air heating, a temperature distribution which is as homogeneous as possible can be achieved in the housing using simple means.

It is advantageous if the circulating air heating comprises a fan, an air filter, an air dryer and a heating element. The air heated by a heating element is circulated by a fan. The air filter is arranged, for example, such that it can easily be removed and cleaned. The air dryer removes moisture from the circulated air in order to impair the conditions for the germs.

It is further proposed that the fan and the heating element be provided in the gear casing of the cutting blade. The heating element is therefore located in the immediate vicinity of the space to be heated, simplifying temperature control. The waste heat from the heating element therefore also heats the gear casing.

It is desirable if an air conveying device distributes the heated air in the machine or gear casing. The air conveying devices can be designed, for example, as air conveying plates or as a pipe or tube system with openings. The heated air is conveyed, for example, to the points in the casing at which a medium is most likely to develop. Furthermore, the air conveying device creates a homogeneous temperature distribution in the casing.

It has been found to be desirable for the heating element to be downstream of the fan and the heating element to sterilise the air. In addition to direct destruction of the germs by the high temperature, the heating means also dries out the medium, preventing it spreading. The dried medium becomes encrusted and detaches itself from the surface in the manner of dust. The detached dust is carried off by the circulating air heating. It is possible for the particles of dust to contain living germs in their interior, but these living germs are destroyed in the heating element when the particles of dust are baked in the heating element. The air thus becomes sterilised.

It is advantageous for a fan to generate a reduced pressure in the casing. This prevents germs or impurities which accumulate in the casing from being blown out of the casing. For this purpose, a further fan is provided in addition to the fan of the circulating air heating.

It has been found that particularly good results are achieved if the casing has a surface heater. This surface heater consists, for example, of an insulated aluminium or other metal strip which is adhered to the interior of the casing and to which current is supplied.

It has been found advantageous for the surface heater to rest on at least a portion of the interior of the casing. Cleaning water which penetrates into the casing and is contaminated with germs accumulates on the base of the casing. The casing has openings for the discharge of fluid, but it is still possible for culture media to develop as, in particular, pieces of sausage or other sliced product are not discharged. These organic residues lie on a surface heater provided, for example, on the interior of the base and are heated and/or dried there to such an extent that the germs can no longer be propagated.

Particularly good results have been achieved if a combination of several heating means is provided for heating the casing. The effect of the heating means is markedly increased by combining two or more heating means such as circulating air heating and surface heating, as not only the climate of the casing but also the casing itself is heated and the living conditions for germs are therefore drastically impaired.

In a preferred embodiment of the invention it is proposed that a climate controller which co-operates with the controller of the machine or of the machine line be provided for controlling the temperature, the relative atmospheric humidity and the pressure in the casing and the temperature of the casing. Machines of the type described are generally operated in shifts and are completely cleaned externally, for example after each shift. It is not always possible to clean the interior of the machine casing so as to create a lack of germs within the casing. If the machine is cleaned at the end of a shift, it is possible to provide in the controller a program which subsequently leads to heating of the casing. The climate controller controls the heating means on the basis of the recorded data (temperature, relative atmospheric humidity, pressure, etc.). This creates a climate which is undesirable for the growth of the germs.

Desirable results are achieved if the circulating air heating means is a closed system.

It is also proposed that a fresh or sterile air supplier be provided in the circulating air heating means. This brings about an exchange of the air in the circulating air heating means. The growth of germs can be prevented by the addition of sterile air, particularly if, for example, a gas which is undesirable for the metabolism of the germs is added.

It is particularly desirable if heating phases are provided in the controller of the machine or of the-line in order to heat the casing. For example, it is not always possible to keep the casing at a certain temperature depending on the place of use of the machine. It is often adequate to provide, in the line controller, heating phases which heat up the casing and therefore reduce the number of germs.

It has proved desirable in experiments if the temperature in the interior of the casing is adjustable in a range of 59° to 67° C. Germ colonies are effectively attacked at temperatures higher than 59° C., but at temperatures above 67° C. there is a risk that the mechanics of the machine, in particular the driving elements, will be damaged or impaired.

It has also been found that very good results are achieved if the temperature of the casing is 59° C. A dissertation by Hans-Werner Stille, Veterinary Surgeon (Institute for Food Hygiene at the Ludwig Maximilian University, Munich, 1994), gives details about the influence of temperatures on germs and the development of their population. It has been found that the development of germs is effectively impaired when the interior of the casing is heated to about 59° C., if possible over a prolonged period.

DETAILED DESCRIPTION OF PREFERRED EMBODIMENTS

Figure 1:
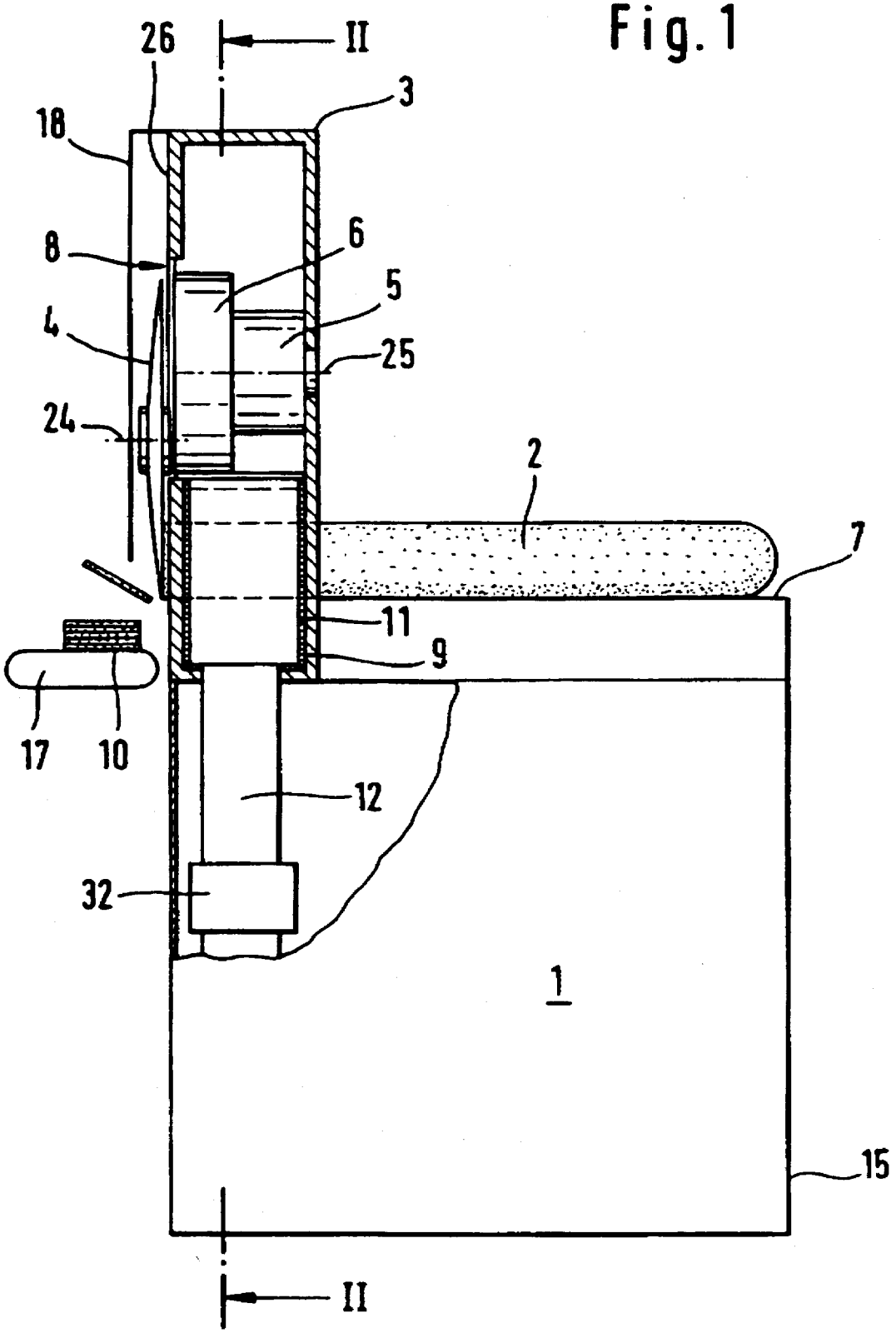
FIG. 1 is a vertical section through a side view of a first embodiment of a machine according to the invention.

Referring first to FIG. 1, a food slicing machine 1 consists of a frame 15 having a product support surface 7. Material to be sliced rests on the product support surface 7. Suitable means (not illustrated) are provided for transporting the material 2 to be sliced.

The material 2 is conveyed toward a revolving cutting blade 4. The cutting blade 4 runs eccentrically round the axis 25 of a drive 5, a planetary gear 6 being provided for this purpose. The planetary gear 6 is driven, for example, by the same drive 5 as the cutting blade 4. The orbit of the cutting blade is designated by 23 in FIG. 2. The cutting blade drive 5, of which the axis 25 lies above the product support surface 7 and the material 2 are, like the planetary gear 6, covered by a casing 3.

There is a gap 8 between the cutting blade drive 5 and planetary gear 6 and the casing 3. This gap 8 is shown on an enlarged scale in FIG. 2.

The revolving cutting blade 4 is concealed by a covering hood 18. This covering hood 18 is connected to the casing 3.

The material 2 is cut by the revolving cutting blade 4, to form a stack 10 of sliced foodstuff, for example sliced sausage, on a support 17 in front of the cutting machine 1.

For cleaning the machine 1, the covering hood 18 can be taken off and the cutting blade 4 removed from the axis 24. The casing wall 26 located behind the cutting blade 4, which in this case extends vertically, may then be sprayed with, for example, a steam jet cleaner.

It is possible, owing to the non-hermetic seal of the gap 8, for spray water and impurities (for example organic material, particles of cut material, etc.) to penetrate into the casing 3 and to accumulate on the base 27 of the casing 3.

So that, for example, fluid can flow out after the cleaning process, openings 31 are provided in the base 27. Fluid is discharged from the machine or the machine casing through an outlet pipe 38. Nevertheless, organic material, spray water, etc. remains in the casing.

According to the invention, the casing 3 is heatable. A heating means 9 is provided for this purpose. The heating means 9 may comprise a surface heater 11. The surface heater 11 is provided on the interior 28 of the casing 3., It is also possible for the surface heater 11 to line the base 27 as well as the vertical flanks of the interior 28.

Figure 2:
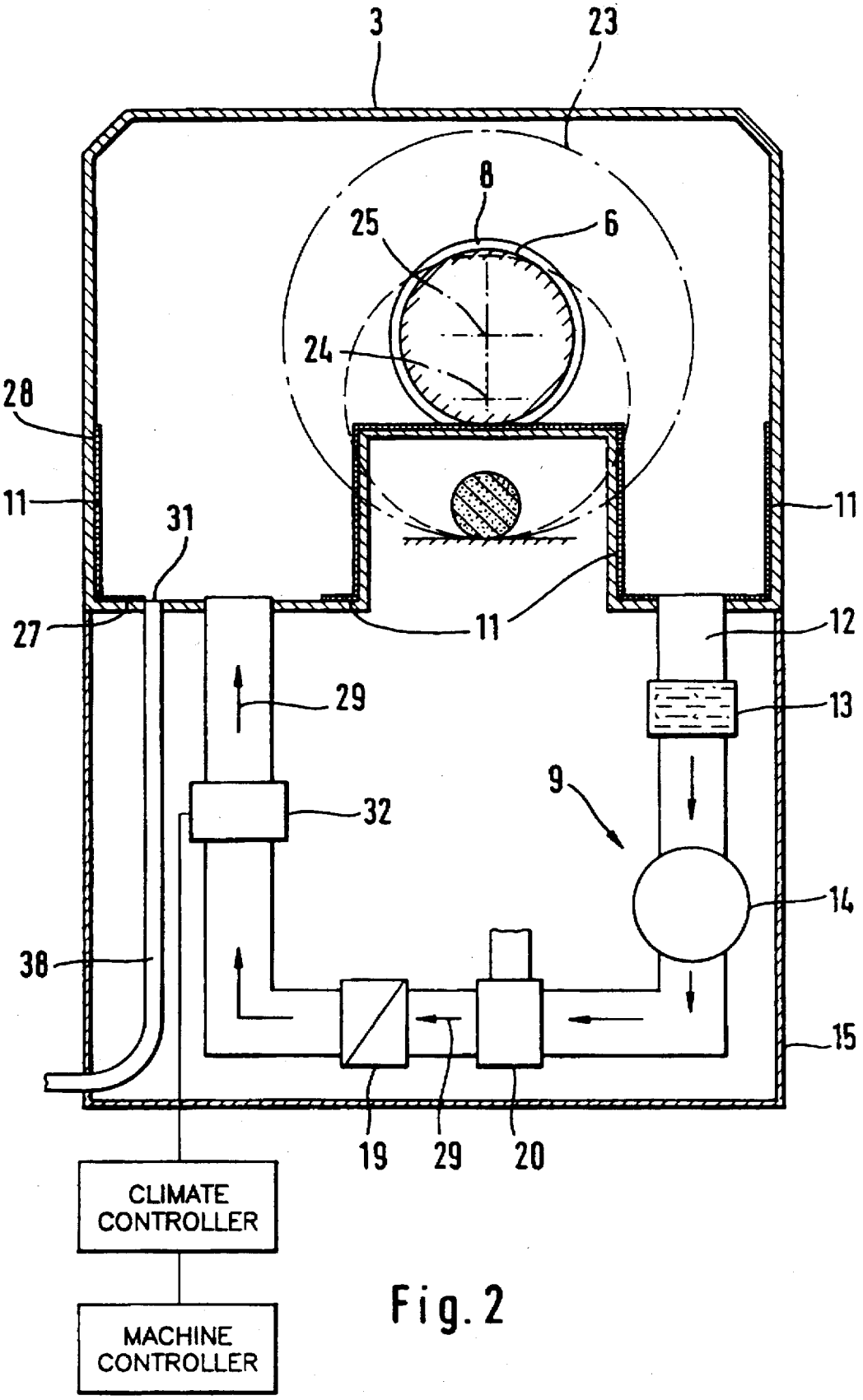
FIG. 2 is a vertical section through a front view of the machine of FIG. 1 along the line II—II.

A further form of heating means 9 is shown in FIG. 2. This is a circulating air heater consisting of a heating element 32, a fan 14, a filter 13, an air dryer 19 and a channel 12 connecting these elements 13, 14, 32 and 19. The elements 13, 14, 32 and 19 may be arranged in any convenient way. Reference numeral 29 designates the direction of flow of the air in the circulating air heater. The circulating air heater may be a closed system. The fan 14 or further fans (not shown) form a vacuum in the casing 3. This prevents germs or spent air being discharged from the casing 3 into the environment without being cleaned. Long-lasting cleaning of the air in the casing 3 is achieved by providing an air dryer 19 or an air mixer 20 or with the filter 13. Through the air mixer 20 it is possible, for example, to supply fresh or sterile air to the air in the casing.

It is particularly advantageous for several heating means to be combined, for example a surface heater 11 and a circulating air heater. On the one hand, the surface heater provides optimum drying of the bacterial culture medium and on the other hand the air located in the casing is dried and cleaned by the circulating air heater means and the propagation and living conditions for germs etc consequently impaired.

Figure 3:
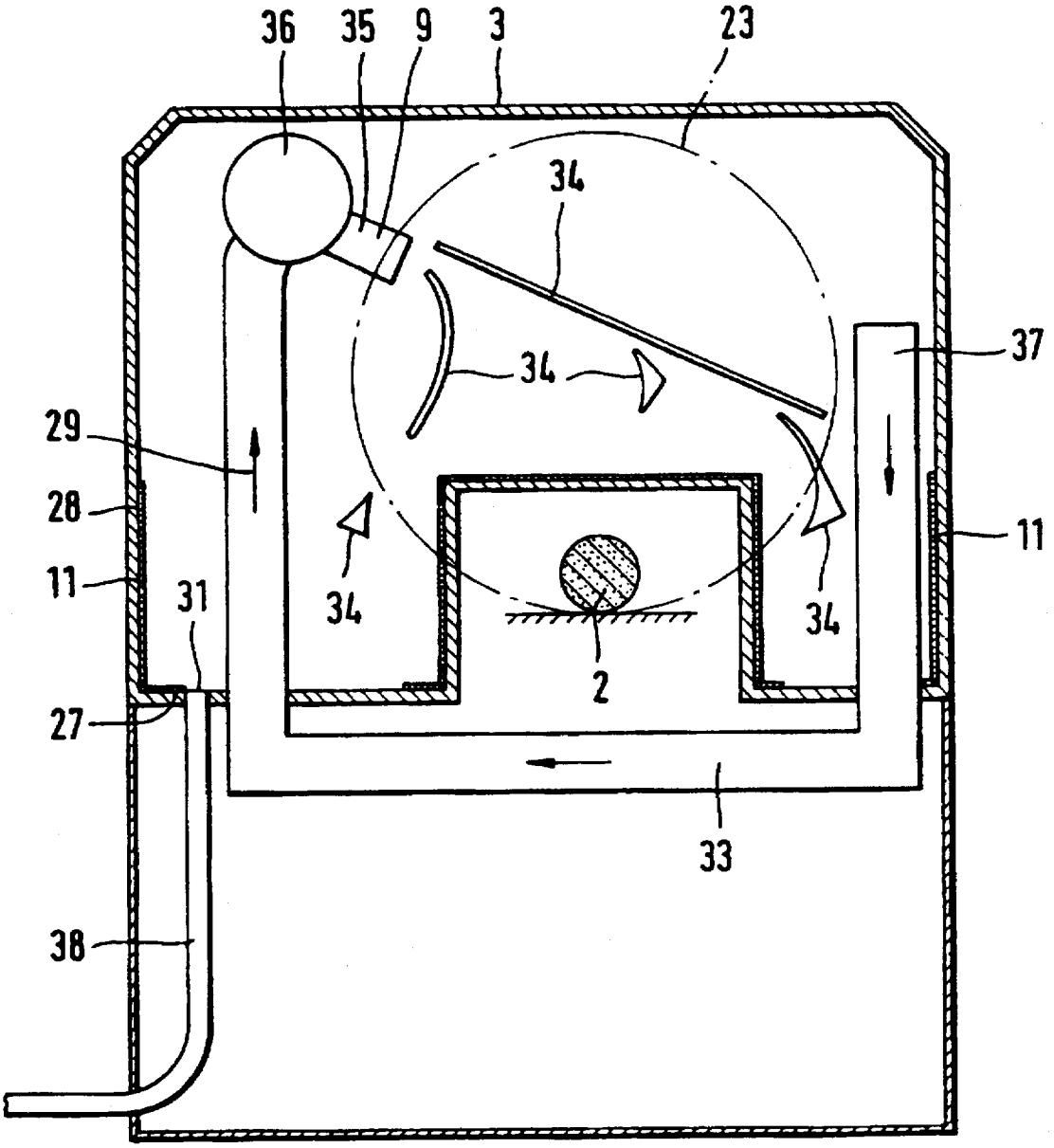
FIG. 3 is a vertical section through a front view of a second embodiment of a machine according to the invention.

FIG. 3 shows a further embodiment of the invention. In this embodiment, a fan 36 is arranged in the interior of the casing 3. The fan 36 is fixed in the upper half of the casing 3. A heating arrangement 35 consists, for example, of a glowing heating wire. The fan 36 conveys air through the heating arrangement 35. Air guide plates 34 are positioned at the outlet of the heating device 35 to provide optimum distribution of the heated air in the interior of the casing 3. It is preferred that the air guide plates 34 be arranged such that the air is conveyed to the internal surfaces of the casing where a culture medium is most likely to form. These are generally the surfaces extending horizontally in the lower region of the casing. The fan 36 draws the air to be heated through a tube or channel 33. At the open end of the tube 33 is a suction nozzle 37 which, in this example, is at a position in the casing 3 which is not directly in the flow path of the circulated air. The invention therefore also achieves an air flow in parts of the casing into which air is not guided by the air guide plates. A more homogeneous temperature distribution in the casing 3 is thus achieved.

It is also possible to provide an intelligent climate controller for, for example, the temperature, the relative atmospheric humidity or the conductivity of the culture medium. This climate controller is connected, for example, to the controller of the machine or of the machine line and influences the heating means accordingly. It is therefore possible, for example, to dry the culture medium by switching on the heating means if the conductivity of the medium is too high. It is also possible to provide a program for phased heating periods, for example in the intervals between shifts etc.

We claim:

1. A machine for treatment or processing of foodstuffs, the machine having a cutter blade, drive means for driving the cutter blade, a casing which encloses the drive means and a heater means associated with the casing for heating air contained within said casing to an elevated temperature in a range of 59° C. to 67° C. for attacking germ colonies within the casing without damaging the drive means.

2. The machine as claimed in claim 1, wherein said heater means comprises a circulating air heater means for providing a heated air flow through said casing.

3. The machine as claimed in claim 2, wherein said circulating air heater means comprises a closed system including a fan for circulating air through the system, an air filter for cleaning the air, an air dryer and a heating element for heating the air.

4. The machine as claimed in claim 3, wherein said fan and said heating element are provided in said casing.

5. The machine as claimed in claim 2, wherein said circulating air heater means comprises a fan and a heating element, said heating element being downstream of said fan in the air flow, and said heating element sterilizes air passing over it.

6. The machine as claimed in claim 2, wherein said circulating air heater means is a closed system.

7. The machine as claimed in claim 1, wherein said heater means comprises a surface heater.

8. The machine as claimed in claim 7, wherein said surface heater rests on at least part of a base wall of the casing and parts of side walls of the casing.

9. The machine as claimed in claim 1, wherein said heater means comprises a combination of more than one heating means.

10. The machine as claimed in claim 1, wherein said heater means comprises a circulating air heater and a surface heater.

11. The machine as claimed in claim 1, wherein said machine further comprises a machine controller and a climate controller operably linked to said machine controller for controlling temperature of the air contained in said casing, relative humidity and air pressure in said casing.

12. The machine as claimed in claim 1, wherein said machine further comprises a machine controller for said air in said heater to heat said casing to the elevated temperature for predetermined lengths of time.

13. The machine as claimed in claim 1, wherein said heater means is arranged to heat said casing to a temperature of 59° C.

14. A machine for slicing of a foodstuff, said machine comprising a cutter blade, a casing, drive means mounted within said casing for driving the cutter blade, and a heater means having a controller for heating said casing and air contained within said casing to an elevated temperature in a range of 59° C. to 67° C. for attacking germ colonies within the casing without damaging the drive means.

15. A machine as claimed in claim 14 wherein said heater includes an air circulating heater means.

16. A machine as claimed in claim 15 wherein said heater further includes a surface contact heater means on internal wall portions of the casing.

17. A machine as claimed in claim 16 wherein said wall portions include base wall portions and side wall portions.

* * * * *